US008382394B1

(12) United States Patent
Van Bruggen et al.

(10) Patent No.: US 8,382,394 B1
(45) Date of Patent: Feb. 26, 2013

(54) DEVICE FOR APPLYING REFLECTIVE PAINT TO ROADSIDE BARRIERS

(75) Inventors: Marvin Lee Van Bruggen, Orange City, IA (US); Matthew Joseph Brossard, Orange City, IA (US); Timothy Brian Altena, Orange City, IA (US)

(73) Assignee: EZ Liner, Orange City, IA (US)

( * ) Notice: Subject to any disclaimer, the term of this patent is extended or adjusted under 35 U.S.C. 154(b) by 1154 days.

(21) Appl. No.: 12/261,551

(22) Filed: Oct. 30, 2008

(51) Int. Cl.
*E01C 23/22* (2006.01)

(52) U.S. Cl. ..... 404/72; 404/83; 404/93

(58) Field of Classification Search ..... 404/6, 94, 404/72, 83, 93
See application file for complete search history.

(56) References Cited

U.S. PATENT DOCUMENTS

| | | | | | |
|---|---|---|---|---|---|
| 3,459,373 | A * | 8/1969 | Koers | 239/1 |
| 3,532,070 | A * | 10/1970 | Lamarque | 118/681 |
| 3,902,666 | A * | 9/1975 | Ito et al. | 239/130 |
| 4,893,751 | A * | 1/1990 | Armstrong | 239/150 |
| 5,054,959 | A * | 10/1991 | Wilson et al. | 404/94 |
| 5,169,262 | A * | 12/1992 | Wilson et al. | 404/84.05 |
| 5,540,518 | A * | 7/1996 | Wambold | 404/84.05 |
| 5,544,972 | A * | 8/1996 | Boldt | 404/75 |
| 5,651,156 | A * | 7/1997 | Oomura | 15/21.1 |
| 6,478,507 | B2 * | 11/2002 | Schroeder et al. | 404/94 |
| 2010/0112340 | A1 * | 5/2010 | Bell | 428/332 |

OTHER PUBLICATIONS

"Lifeguard Safety Spheres", Potters Industries Inc., Valley Forge, PA, pictures from brochure (2007).

* cited by examiner

*Primary Examiner* — Raymond W Addie
(74) *Attorney, Agent, or Firm* — McKee, Voorhees & Sease, P.L.C.

(57) ABSTRACT

A carriage having a paint nozzle and reflective bead nozzle is provided for rolling along a roadside barrier, such as a guard rail or Jersey wall, to apply a reflective paint stripe on the barrier to improve visibility of the barrier at night. The carriage includes a first set of wheels to support the carriage on an upper edge of the barrier, and one or more additional sets of wheels to maintain proper spacing between the nozzles and the barrier surface being painted. The carriage includes handles with controls for actuating the nozzles. The paint and bead nozzles are connected to the paint system and pressurized bead tank on a paint striper, which may move simultaneously with the carriage along the barrier during the painting process.

20 Claims, 7 Drawing Sheets

DEVICE FOR APPLYING REFLECTIVE PAINT TO ROADSIDE BARRIERS

CROSS-REFERENCE TO RELATED APPLICATIONS

This application claims priority under 35 U.S.C. §119(e) to provisional application 61/001,533 filed Nov. 2, 2007, herein incorporated by reference in its entirety.

BACKGROUND OF THE INVENTION

It is well-known to apply reflective paint stripes to roadways so as to delineate travel lanes on the road. These stripes are applied with a mobile paint striper, which includes a paint supply system, an air compressor, and a pressurized tank of reflective beads. The striper includes a paint nozzle and a bead nozzle which are connected by hoses to the paint and bead tanks, respectively. When the paint striper is operated, a stripe of paint is applied to the road surface, with the reflective beads then being applied on top of the wet paint. The beads enhance the visibility of the stripe at night by reflection of a vehicle's headlights. The paint striping machines come in various setups, including a walk behind unit, a self-propelled riding unit, a palletized unit, and a truck mounted unit.

Barriers, such as guardrails and Jersey walls, are often provided along roadways, such as along curves, steep drop offs from the shoulder of the road, and divided roadways. Small reflector posts are sometimes utilized at spaced intervals along the barriers. However, the size of the reflectors and the spacing between reflectors minimize their effectiveness in warning a driver of curves in the road and other potentially hazardous situations.

It is known in the art to apply a reflective paint stripe to a vertical surface of the barrier by one person holding a template in one hand and a paint spray gun in the other hand and walking along the wall, while the second person follows with a bead spray nozzle. This prior art method of painting a striping on the barrier is slow and labor intensive, and thus costly.

Therefore, a primary objective of the present invention is the provision of an improved method and means of applying a reflective paint stripe to a surface of a roadway barrier.

Another objective of the present invention is the provision of a device for applying a reflective paint stripe to a roadside barrier surface in an accurate, efficient, economical and practical manner.

A further objective of the present invention is the provision of a carriage which rolls along a roadside barrier while applying a paint stripe and reflective beads to a surface of the barrier.

Still another objective of the present invention is the provision of a paint striping carriage which moves in unison with a paint striper along a roadside barrier to quickly and easily apply a reflective paint stripe on a surface of the barrier.

Yet another objective of the present invention is a method of applying a reflective paint stripe to a surface of a roadside barrier in a single pass.

These and other objectives will become apparent from the following description of the invention.

SUMMARY OF THE INVENTION

The present invention is directed towards a device for applying a reflective paint stripe to a roadside barrier, such as a guardrail or a concrete Jersey wall so as to increase driving safety, particularly at night. The device includes a carriage adapted to roll along and adjacent the surface to which the paint stripe is to be applied. The carriage includes a frame which supports a plurality of wheels. One set of wheels rolls along an upper horizontal surface of the guardrail or wall, while another set of wheels rolls along a surface of the rail or barrier so as to maintain proper spacing between the spray nozzles on the carriage and the surface to be striped. The device has two spray nozzles, the first of which applies a layer of paint to the surface, followed by a second nozzle to spray reflective beads onto the wet paint. The nozzles are connected via hoses to a mobile paint striper. The striper includes a paint supply system, an air compressor, and a pressurized bead tank. The carriage and striper move substantially in unison along the barrier to apply the reflective paint stripe in a single pass.

The present invention provides a method and a device to safely and efficiently apply reflective paint stripes on roadside barriers by spraying paint and reflective beads onto the vertical surfaces of concrete Jersey walls and onto "W" shaped galvanized steel guardrails. The goal is to make barriers around curves and over bridges more visible at night to prevent vehicle impacts.

In use, the painting carriage can be manually positioned and accurately moved on Jersey walls as high as 32" in height and on "W" guardrails as low as 20" in height. One operator positions the painting carriage on the wall or railing and walks slowly forward while manually triggering the paint and bead guns. The WFT of the paint is controlled by the operator's walking speed or a powered drive. The carriage is constructed of light weight materials as much as possible for ease of handling on long runs.

The paint and beads are provided from the small mobile paint stripping unit capable of delivering a sufficient amount of paint and beads via hoses to the painting carriage, with a second operator pushing or guiding the striper alongside or slightly behind at the same pace of the carriage operator. A self propelled striper can be used for painting "W" railings along roadways with rough terrain. The striper has an adequate paint supply system to ensure that a clean edged line is applied, and an air compressor to provide a pressurized source for bead application.

Another embodiment requiring only one operator, the method of applying the paint and beads to Jersey walls and "W" guardrails is to be done with the carriage capable of tracking on a Jersey wall or "W" rail with wheels or rollers. The device carries the paint nozzle, bead nozzle and delivery hoses and accurately maintains a preset distance from the gun tips to the wall during application process. The painting carriage is supported by a hydraulic or air powered source electrically or electronically controlled to keep the carriage accurately positioned and in constant contact with the wall during the paint/bead application process. The height of the painting carriage is adjustable to paint Jersey walls as high as 32" in height and "W" guardrails as low as 20" in height.

The painting carriage is attached via a support arm or outrigger that is mounted onto the right side or to the right front of a mobile self powered paint striping vehicle. Since this type of application may be limited to short runs at somewhat distant locations, a mobile paint striping unit capable of highway speeds may be highly desirable. The paint and beads are to be remotely delivered via hoses from an existing mobile paint striping unit equipped with all necessary equipment to adequately deliver paint and beads to the painting carriage. The ability to accurately control the speed of the painting carriage by the supporting vehicle is important to achieve the specified paint thickness and accurate application and embedment of the beads. The painting carriage may have sensors or manual controls to start and stop the paint and bead application process at beginning and end of runs, and at intermittent points along the "W" railing in order to not paint over protruding reflectors which may be mounted on the guardrail. (See "W" guardrail spec)

Paint is applied horizontally at a 90 degree angle from the surface being painted via a pressurized paint supply system on the paint striper. The paint and bead nozzles are adjustable for varying line widths from 4" to 6".

It is the intent and purpose of this invention to describe the minimum requirements of a safety barrier line marking system. The system is designed and manufactured to safely and efficiently apply 4" to 6" wide reflective paint lines on a vertical surface such as a concrete bridge wall, Jersey barrier/K-rail traffic divider, and/or W-beam guardrail. The objective is to make barriers around curves and over bridges more visible at night to prevent vehicle impacts and run-off-the road type accidents.

DETAILED DESCRIPTION OF THE INVENTION

Figure 1:
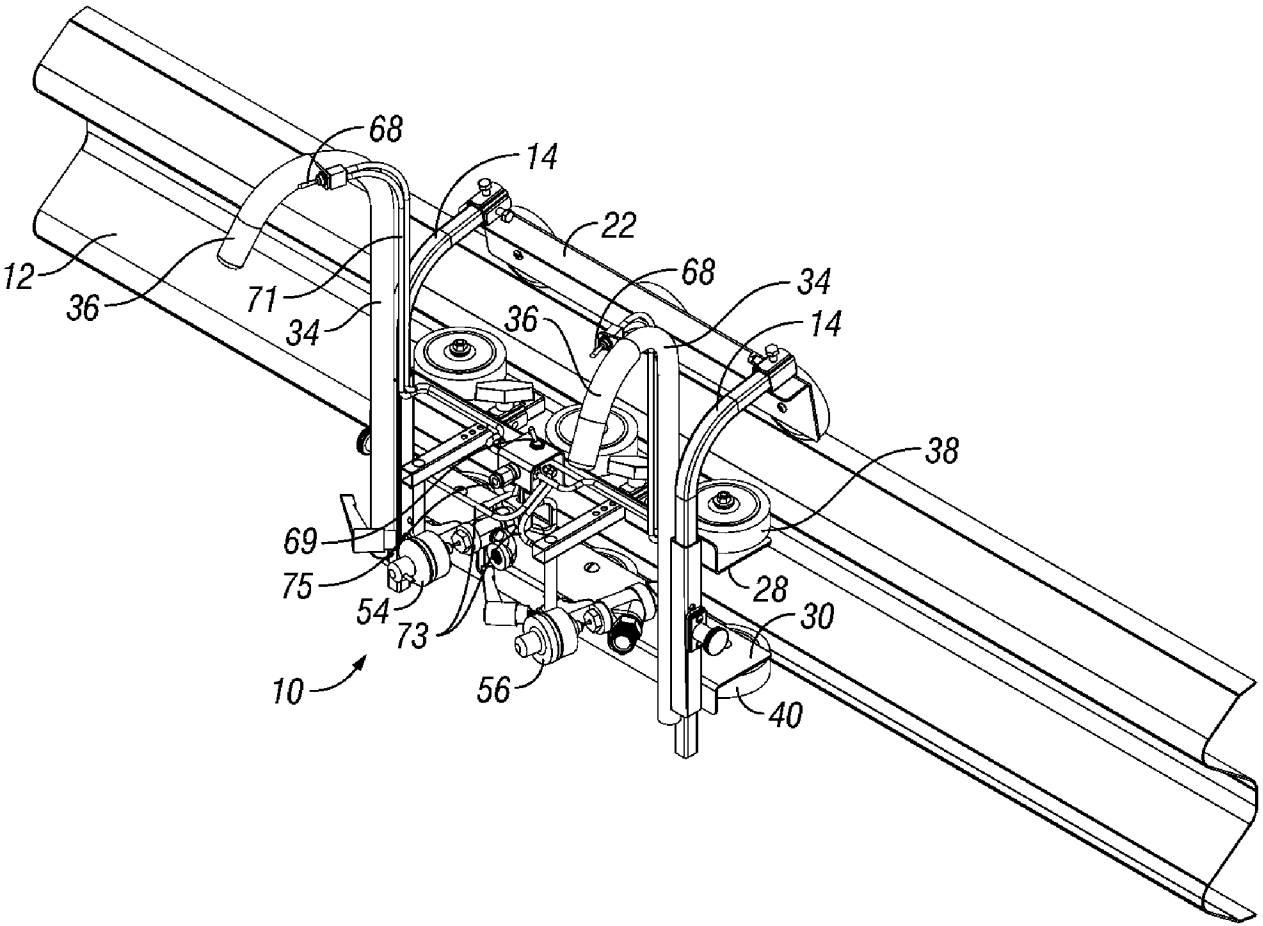
FIG. 1 is a perspective view of the device mounted on a W-shaped galvanized steel guardrail.

The device of the present invention generally comprises a carriage 10 which rolls along a roadside barrier 12, such as a guardrail or Jersey wall. The carriage 10 is connected by hoses to a conventional mobile paint striper (not shown).

The carriage 10 includes a pair of arms 14 each having a substantially vertical lower portion 16 and a substantially horizontal, forwardly extending upper portion 18. A tubular collar 20 is adjustably mounted on the upper portion 18 of each arm 14. An upper cross brace 24 extends between the collars 20. The collars 20 are adjustably secured to the arms 14 by bolts or knobs 24. A second set of collars 26 are adjustably mounted on the lower portions 16 of the arms 14. A middle cross brace 28 and a lower cross brace 30 extend between the collars 26. The collars 26 are secured at a desired position on the arms 14 by adjustment knobs 32. The arms 16 and braces 22, 28, 30 provide a rigid frame when assembled.

A pair of handles 24 extend upwardly from the collars 26 and terminate in hand grips 36. Alternatively, the handles 34 can be connected to the arms 14. In the drawings, the handles 34 are shown to curve downwardly, although it is understood that handles may take other configurations without departing from the scope of the present invention.

The carriage 10 includes wheels which allow the carriage to roll along the guardrail 12 or Jersey wall. More particularly, a first set of upper wheels 38 are mounted on the upper cross brace 22 for rotation about a substantially horizontal axis. A set of middle wheels 40 are mounted on the middle cross brace 28 for rotation about a substantially vertical axis. A set of lower wheels 42 are mounted on the lower cross brace 30 for rotation about a substantially vertical axis. In the preferred embodiment, three wheels are included in each set. However, more or less wheels can be utilized on the carriage 10. The upper wheels 38 generally support a substantial portion of the weight of the carriage 10, while the middle wheels 40 and lower wheels 42 maintain the spacing of the carriage 10 relative to the guard rail or Jersey wall. The wheels 38, 40, 42 may be adjustably mounted on the carriage 10 in any convenient manner, such as slots in the cross braces 22, 28, 30 to selectively position the wheel axles.

The middle cross brace 28 has a pair of sleeves 44 each of which adjustably receive a rearwardly extending arm or post 46. The plurality of holes 48 in the arms 46 allow the position of the arms 46 relative to the cross base 28 to be selectively set via the knob 50. A leg 52 extends downwardly from each arm 46. A paint spray nozzle 54 is adjustably mounted on one of the legs 52, while a bead spray nozzle 58 is adjustably mounted on the other leg 52. The nozzles 54, 56 are locked in position on the legs 52 by a rotatable cam lever 58 or any other convenient handle, knob, pin or fastener.

The paint nozzle 54 includes a coupling 60 for a hose (not shown) extending to the paint supply system on the paint striper. A second coupling 62 on the paint nozzle 54 connects a hose (not shown) extending to the air compressor of the paint striper. The bead nozzle includes a coupling 64 to connect a hose (not shown) extending to the pressurized bead tank of the paint striper. The bead nozzle 56 also includes a second coupling 66 to connect an air hose extending to the compressor of the paint striper.

Control switches 68 are preferably mounted on the hand grips 36 and operatively connected to the nozzles 54, 56 to control the flow of paint, air and beads to the nozzles 54, 56. For example, the left hand grip can control the supply of paint and air to the paint nozzle 54, and the switch on the right hand grip 36 can control the flow of air of beads to the bead nozzle 56. A reversing switch 69 is provided on the carriage 10, which allows the carriage to be moved in either direction along the barrier 12. A pair of air hoses 71 extend between each switch 68, and the reversing switch 69. A pair of air hoses 73 also extends from the reversing switch 69 to the respective nozzles 54, 56. A coupler 75 on the switch 69 for a hose (not shown) is connected to the air compressor of the paint striper. Preferably, the carriage 10 is moved along the barrier 12 in the same direction as traffic flow. Therefore, depending on which side of the road the barrier 12 is located, the carriage movement may be right to left or left to right. The nozzles 54, 56 can easily be reversed on the legs 52, and the switch 69 actuated to the selected orientation of the nozzles 54, 56.

Figure 2:
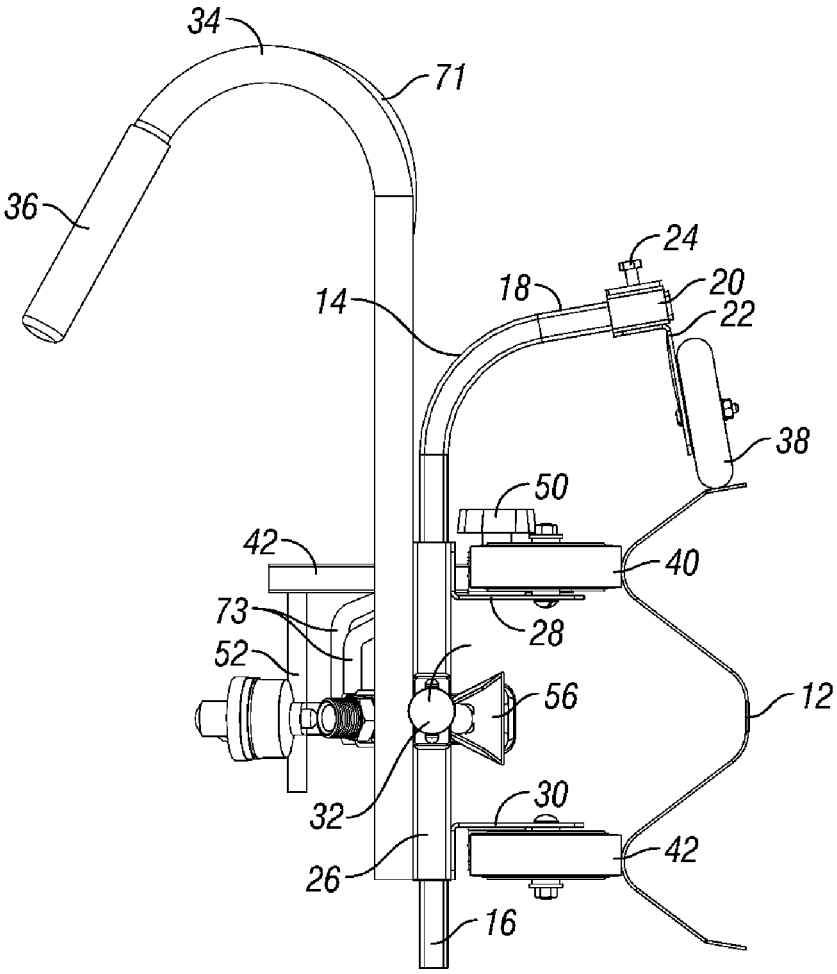
FIG. 2 is an end elevation view of the device mounted on the guardrail.
Figure 3:
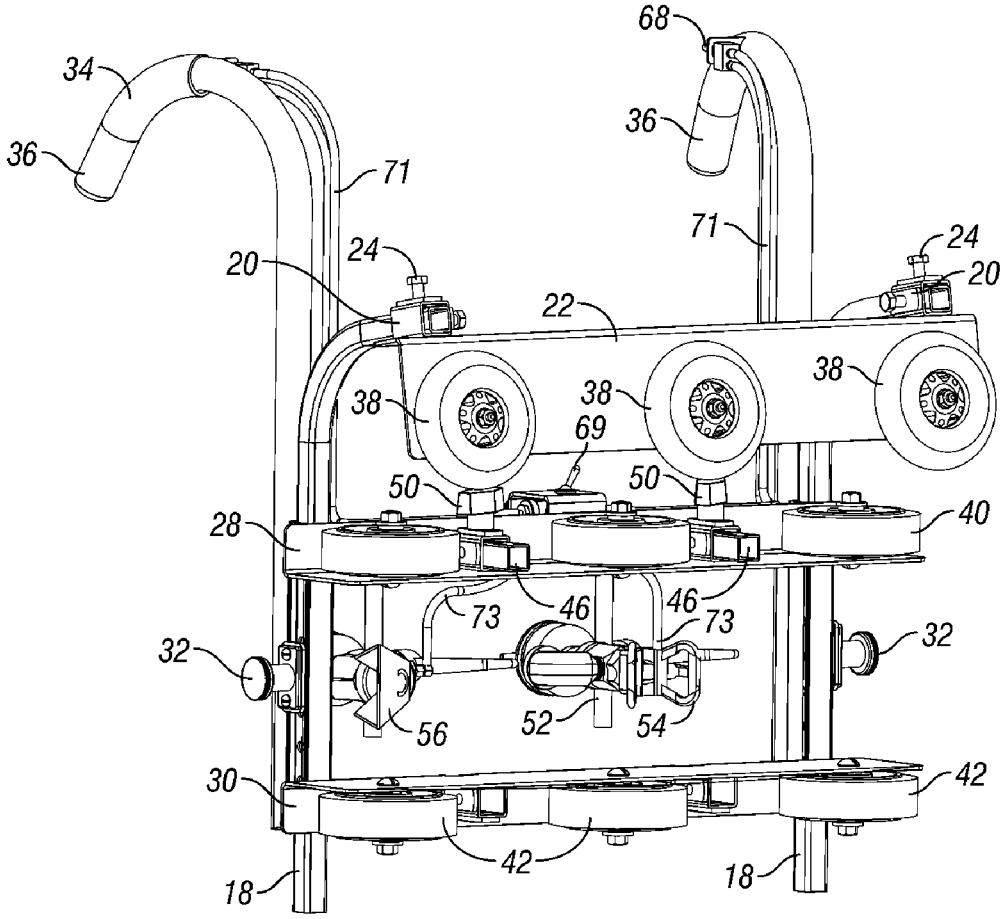
FIG. 3 is a front perspective view of the device, with hoses and switches removed for clarity.
Figure 4:
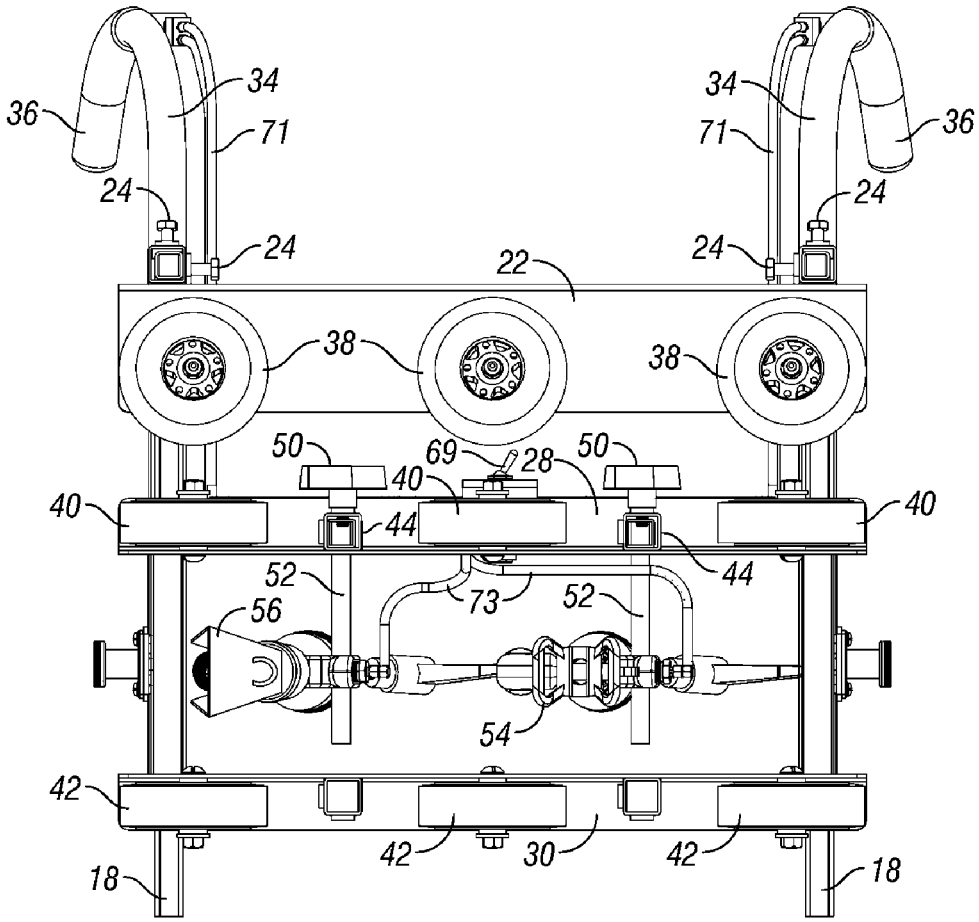
FIG. 4 is a front elevation view of the device, with hoses and switches removed for clarity.
Figure 5:
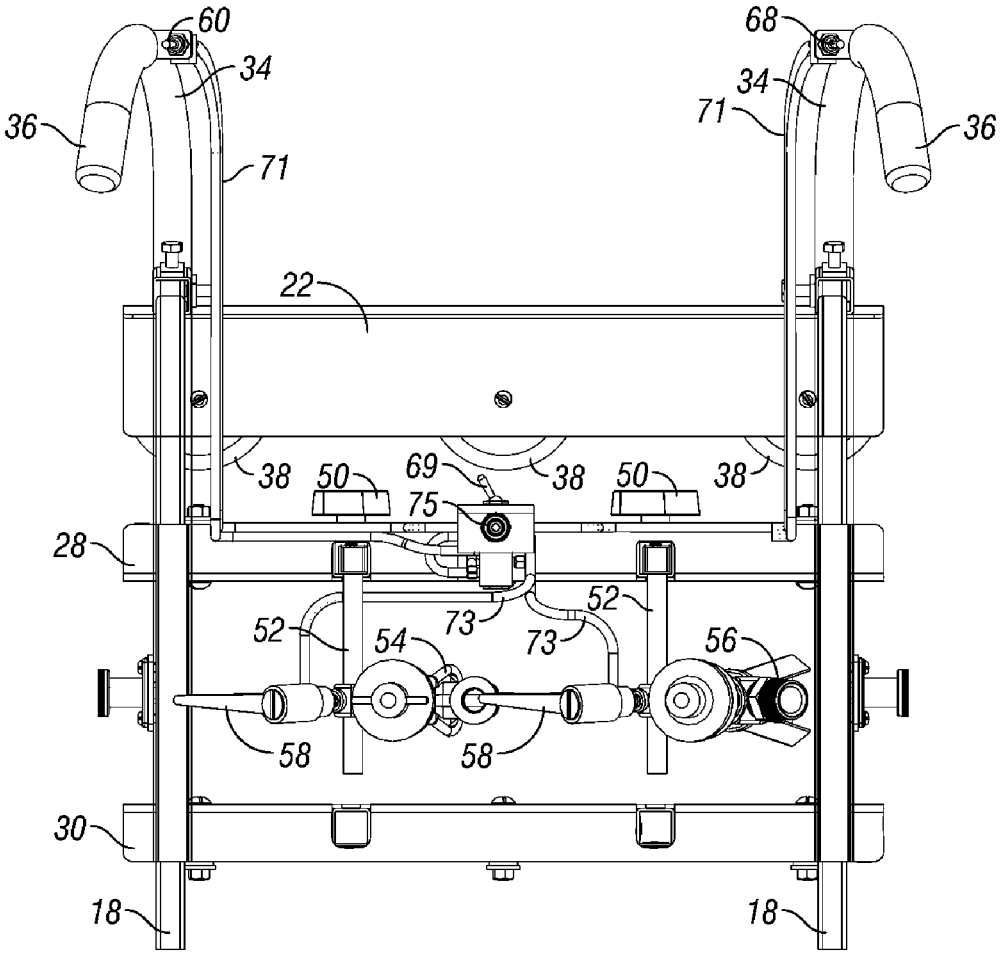
FIG. 5 is a rear elevation view of the device, with hoses and switches removed for clarity.
Figure 6:
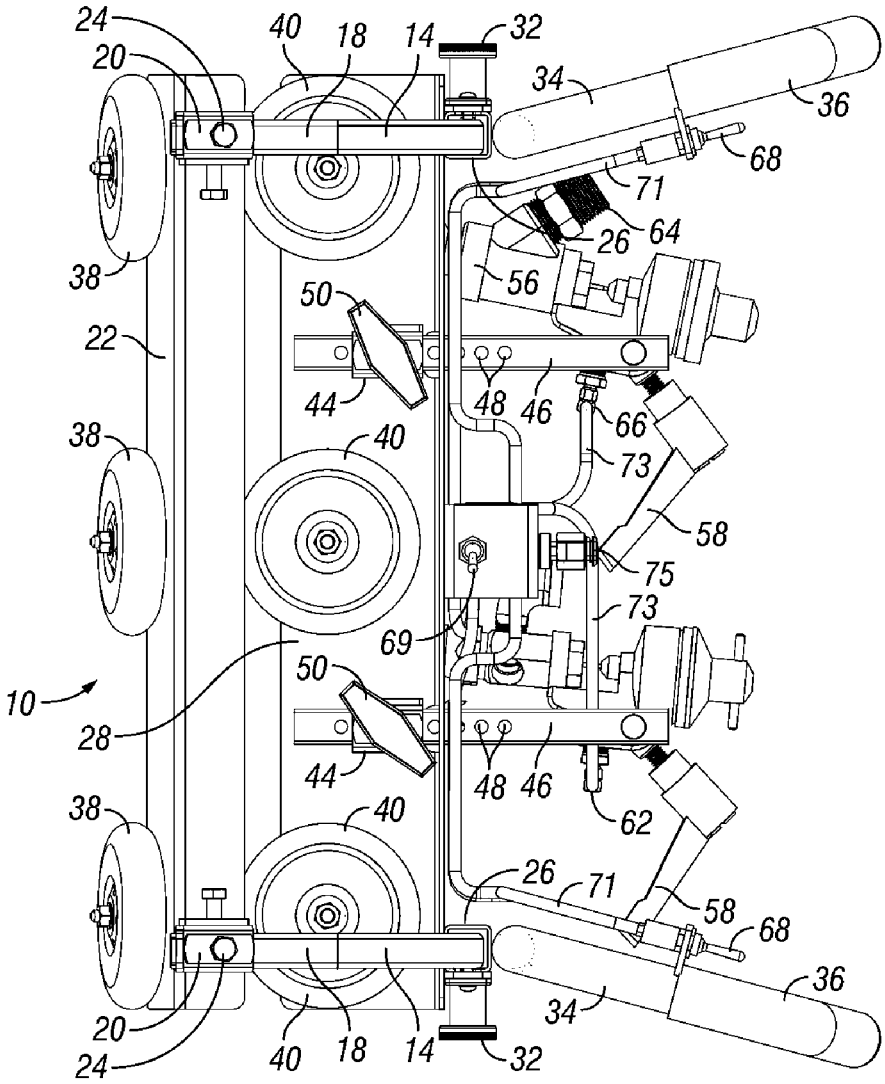
FIG. 6 is a top plan view of the device, with hoses and switches removed for clarity.
Figure 7:
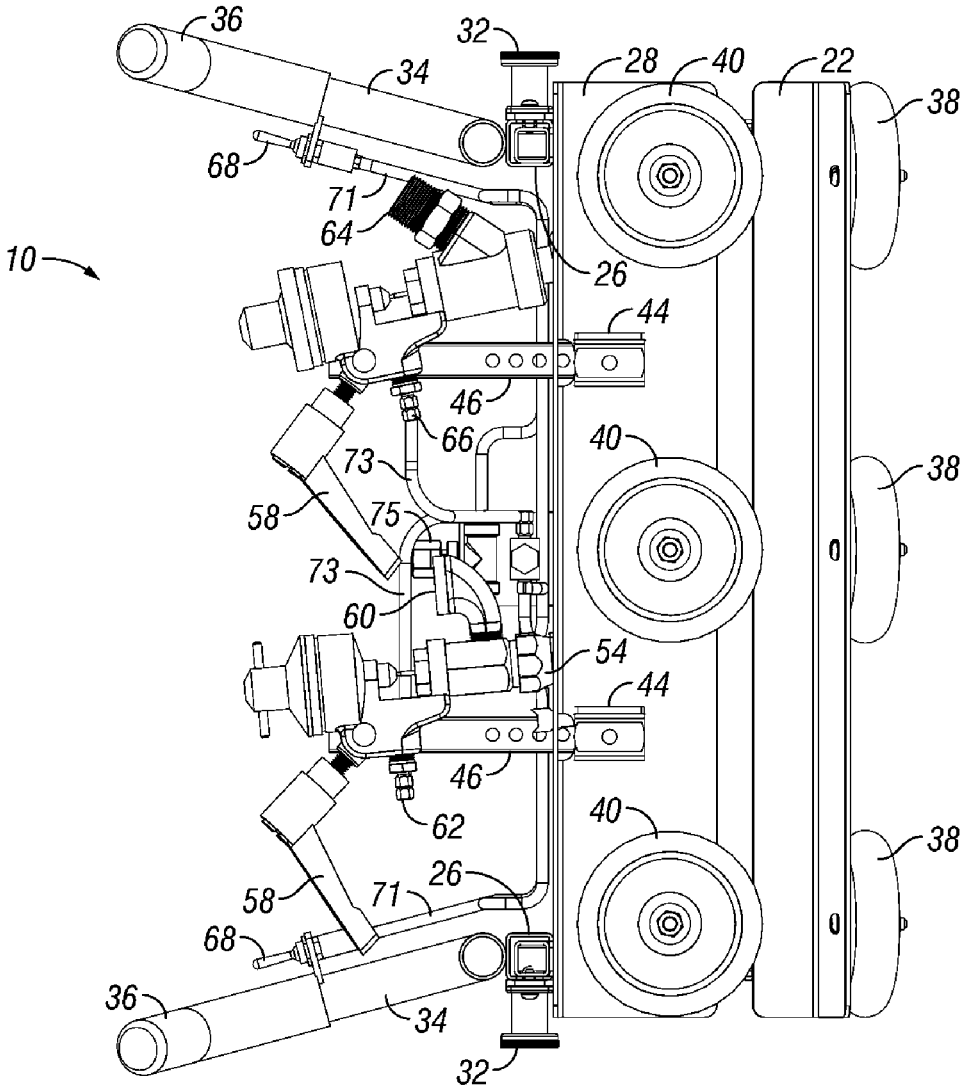
FIG. 7 is a bottom plan view of the device, with hoses and switches removed for clarity.

In operation, after the hoses are connected to the paint coupling 60, bead coupling 64, and air couplings 62, 66, the carriage 10 can be lifted into position on the barrier 12. The upper wheels 38 are set upon the upper edge of the barrier to support the weight of the carriage 10. The middle and lower wheels 38, 40 engage the face of the barrier. For example, as best seen in FIG. 2, the wheels 38 and 40 engage the peeks on the W-shaped guard rail 12. Similarly, the wheels 40, 42 will engage the substantially vertical surface of the Jersey wall. The wheels 38, 40 maintain the appropriate spacing between the paint and bead nozzles 54, 56 and the surface being painted. Thus, a reflective paint stripe can be applied to the recessed valley of the guard rail 12 and to the vertical surface of the Jersey wall adjacent the upper edge of the wall. An operator can easily walk along the guard rail or wall as another operator moves the paint striper substantially in unison with the carriage 10 for long or extended paint stripes. For shorter stripes, the hoses between the carriage 10 and the paint striper may have sufficient length to allow the carriage 10 to move along the barrier without moving the paint striper. In either instance, the paint nozzle 54 applies the paint ahead of the bead nozzle 56, which then applies the reflective beads for retention in the wet paint.

The reflective stripe on the barrier functions similarly to the reflective stripes on road surfaces. Such functionality is achieved through proper application of the paint and beads to the barrier surface. For example:

Paint application: Yellow, white or other colored paint as specified paint, capable of long term adherence to concrete and galvanized steel surfaces, applied at a width of approximately 4-6" at an adequate wet film thickness (WFT) to ensure hideability and allow proper embedment of reflective beads but yet prevent sagging of the paint.

Bead application: Glass reflective beads, applied via gun from pressurized container into the paint in sufficient force to embed beads into the paint at a depth of up to approximately 50% to ensure proper adhesion, yet allow optimum reflectivity.

Paint to be applied via a paint gun with nozzles set to deliver clean edged lines in the above specified widths and thickness.

Beads to be applied via pressure controlled vessels and guns with adjustable fan widths to control the width of the bead pattern, correct amount of beads applied, and proper depth of embedment.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A device for applying reflective paint to a substantially vertical surface of a roadside barrier from a paint striper assembly having a paint supply system, an air compressor, and a pressurized bead tank, comprising:

a carriage;

a first roller assembly on the carriage and having a substantially horizontal axis of rotation for rolling along a substantially horizontal top surface of the barrier;

second and third roller assemblies on the carriage, both having substantially vertical axes of rotation, and being vertically spaced apart, for rolling along a substantially vertical surface of the barrier;

a handle assembly on the carriage for gripping by an operator to manually roll the carriage along the barrier;

a paint nozzle on the carriage;

a reflective bead nozzle on the carriage;

a hose connecting the paint nozzle to the paint supply system; and a hose connecting the bead nozzle to the bead tank.

2. The device of claim 1 wherein each roller assembly includes multiple wheels adapted to engage and roll along the barrier.

3. The device of claim 2 wherein the first and second roller assemblies are adjustably mounted on the carriage for use of the carriage on W-shaped guard rails and on Jersey walls.

4. The device of claim 1 wherein the paint nozzle is ahead of the bead nozzle with respect to a line of travel for the carriage.

5. The device of claim 1 wherein the paint and bead nozzles are laterally spaced part.

6. The device of claim 1 wherein the nozzles are oriented on the carriage at a non-perpendicular angle relative to a line of travel for the carriage along the barrier.

7. The device of claim 1 further comprising controls on the handle assembly for opening and closing the nozzles.

8. The device of claim 1 wherein the carriage is free of structural members extending behind the barrier.

9. The device of claim 1 wherein the carriage is supported on the barrier by the first roller assembly without clamping the carriage to the barrier.

10. A method of applying reflective paint to a front face surface of a roadside barrier, comprising:

positioning a carriage on the barrier and the carriage including paint and head nozzles operatively connected to a paint striper;

maintaining accurate positioning of the carriage relative to the barrier using a first roller on the carriage engaging an upper surface of the barrier and a pair of vertically spaced rollers on the front face surface of the barrier;

manually rolling the carriage along the barrier;

spraying paint onto the surface ; and then spraying reflective beads into the paint while the paint is wet; and the paint and beads being sprayed as the carriage moves along the barrier.

11. The method of claim 10 wherein the carriage hangs from the barrier.

12. The method of claim 10 further comprising maintaining a set spacing between the nozzles and the front face surface.

13. The method of claim 12 wherein the spacing is maintained by the pair of rollers.

14. The method of claim 10 wherein the paint and heads are applied in a single pass.

15. The method of claim 10 further comprising connecting a paint supply system and a bead tank of a mobile paint striper assembly to the paint and bead nozzles, respectively.

16. The method of claim 15 further comprising moving the paint striper assembly along the barrier simultaneously with movement of the carriage.

17. The method of claim 10 further comprising adjusting the first roller and the pair of rollers for use of the carriage on W guard rails and on Jersey walls.

18. The method of claim 10 further comprising maintaining the rear of the barrier free from structure on the carriage.

19. The method of claim 10 further comprising supporting the weight of the carriage on the barrier without clamping the carriage to the barriers.

20. The method of claim 10 further comprising directing the nozzles at a non-perpendicular angle relative to the line of travel for the carriage along the barrier.

* * * * *

UNITED STATES PATENT AND TRADEMARK OFFICE

CERTIFICATE OF CORRECTION

PATENT NO. : 8,382,394 B1
APPLICATION NO. : 12/261551
DATED : February 26, 2013
INVENTOR(S) : Van Bruggen et al.

It is certified that error appears in the above-identified patent and that said Letters Patent is hereby corrected as shown below:

In the Claims:

Col. 6, Line 38, Claim 14:
DELETE after and "heads"
ADD after and --beads--

Signed and Sealed this
Fourteenth Day of May, 2013

Teresa Stanek Rea
*Acting Director of the United States Patent and Trademark Office*